US009488048B2

(12) United States Patent
Keller

(10) Patent No.: US 9,488,048 B2
(45) **Date of Patent: *Nov. 8, 2016**

(54) GROUND AND ROCK ANCHOR

(71) Applicant: F.J. Aschwanden AG, Lyss (CH)

(72) Inventor: Thomas Keller, Lully (CH)

(73) Assignee: F.J. Aschwanden Ag, Lyss (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/331,756

(22) Filed: Jul. 15, 2014

(65) Prior Publication Data

US 2015/0023740 A1 Jan. 22, 2015

(30) Foreign Application Priority Data

Jul. 22, 2013 (EP) ..... 13177343

(51) Int. Cl.
*E21D 20/00* (2006.01)
*E21D 21/00* (2006.01)
*E02D 5/80* (2006.01)

(52) U.S. Cl.
CPC ..... *E21D 21/0026* (2013.01); *E02D 5/80* (2013.01); *E21D 21/0046* (2013.01)

(58) Field of Classification Search
USPC ..... 405/259.1, 259.5, 288, 302.2
See application file for complete search history.

(56) References Cited

U.S. PATENT DOCUMENTS 3,472,120 A 10/1969 Taylor
3,999,391 A * 12/1976 Meredith ..... E02D 5/76 405/259.5
5,472,296 A * 12/1995 von Allmen ..... E02D 5/80 405/233
6,571,518 B1 * 6/2003 Barley ..... E04C 5/127 405/259.1
8,429,877 B2 * 4/2013 Keller ..... E04G 23/0237 52/223.11

FOREIGN PATENT DOCUMENTS

CH 701928 B1 1/2011
CH 701928 * 4/2011
EP 1589146 A1 10/2005

OTHER PUBLICATIONS

European Search Report (Apr. 22, 2014) for corresponding European App. EP 13 17 7343.

* cited by examiner

*Primary Examiner* — Sean Andrish
(74) *Attorney, Agent, or Firm* — WRB-IP LLP

(57) ABSTRACT

A ground and rock anchor includes a longitudinally stable, flexible tensile member, an anchorage part, in which the tensile member may be fixed by the one end region, and an anchor head device, in which the tensile member is held by the other end region. The anchorage part is designed to be introduced into a drilled hole in the ground or rock and anchored therein. The longitudinally stable, flexible tensile member is provided at least at the one end region fixed in the anchorage part with at least one first loop. The anchorage part is a substantially prismatic or cylindrical longitudinal body, which is formed of a hardenable composition, by which the at least one first loop of the longitudinally stable, flexible tensile member is surrounded. This configuration allows the forces to be optimally transferred.

13 Claims, 5 Drawing Sheets

FIG. 6
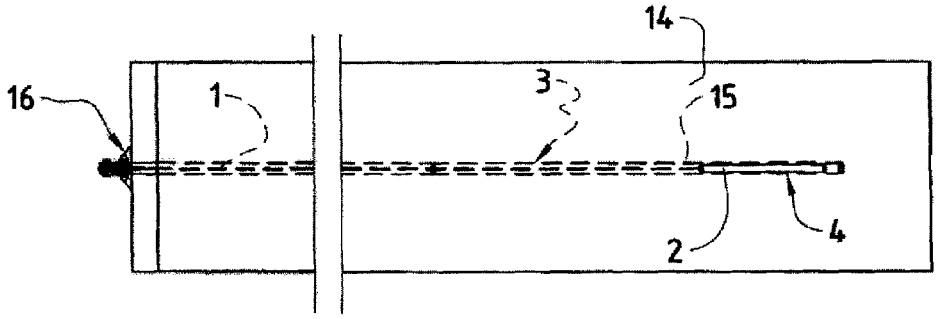
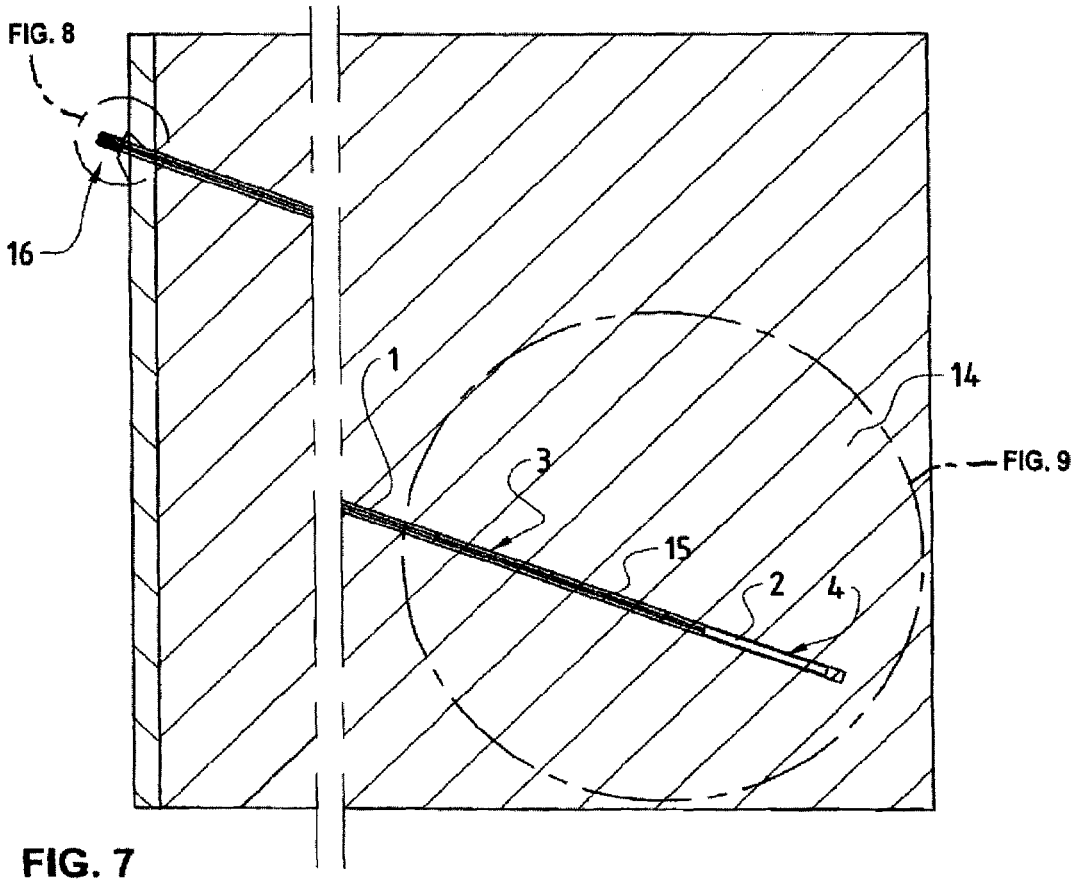
FIG. 7

GROUND AND ROCK ANCHOR

BACKGROUND AND SUMMARY

The present invention relates to a ground and rock anchor, comprising a longitudinally stable, flexible tensile member, an anchorage part, in which the tensile member is fixed by the one end region, and an anchor head device, in which the tensile member is held by the other end region, which anchorage part is designed to be introduced into a drilled hole in the ground or rock and anchored therein.

Such ground and rock anchors serve in particular to stabilise slopes and rock faces, by introducing the forces to be absorbed by the anchorage part in the surface region of the ground and rock masses to be stabilised into deeper-lying stable soil layers. To transfer these forces from the anchorage part into the deeper-lying soil layers, a tensile member is used which is conventionally formed from a bar or wire strands, which are anchored in the deeper soil layers. To this end, these bars or wire strands are fixed by way of a mortar composition injected into the corresponding drilled hole. The anchor head device allows the tensile member to be tensioned, while an anchorage plate, on which a supporting section is supported, allows the surface soil or the rock masses to be appropriately stabilised.

Such ground and rock anchors are intended for permanent use, which means that the corresponding components of the ground and rock anchors must in particular be protected against corrosion. To this end, the most varied methods are known; for example the tensile member may be inserted into a plastics sheath, or the tensile members may also be accommodated in plastics pipes, which are filled with grease, for example.

Production of such corrosion-protected ground and rock anchors is relatively complex; in particular it is also necessary for such ground and rock anchors to be tested in the installed state, to establish whether corrosion has set in, which can have a very negative effect on the strength of such ground and rock anchors. Such monitoring processes are performed for example in known manner by resistance measurements, which is likewise complex.

It is desirable to provide a ground and rock anchor which is simple to produce, and with which in particular anchorage in the drilled hole and also at the anchorage part may take place optimally.

According to an aspect of the invention, the longitudinally stable, flexible tensile member comprises at least one first loop at least at the one end region which is fixed in the anchorage part, and that the anchorage part is a substantially prismatic or cylindrical longitudinal body, which is formed of a hardenable composition, by which the at least one first loop of the longitudinally stable, flexible tensile member is surrounded.

The anchorage part with the at least one first loop of the longitudinally stable, flexible tensile member fixed therein is prefabricated, and it is therefore ensured that fixing of this loop in the anchorage part is optimal. This longitudinal body formed from a hardenable composition and having the fixed tensile member is inserted into the drilled hole and, by injecting a further hardenable composition into the drilled hole, the longitudinal body is anchored and held optimally at the bottom of the drilled hole.

The longitudinally stable, flexible tensile member is advantageously made from a fibre reinforced plastics material, preferably carbon fibre reinforced plastics material, whereby corrosion can be ruled out. Such a tensile member additionally has the advantage of being pliable; the flexible tensile member may for example be rolled up for transport of the ground and rock anchor, which saves space with regard to the lengthwise extent of such rock anchors. Through the possibility of rolling up or bending over the longitudinally stable, flexible tensile member the space requirement means that only a minimal amount of space is required in front of the drilled hole on insertion of the ground and rock anchor.

Advantageously, the longitudinally stable, flexible tensile member consists of a plurality of layers, wherein in the one end region, which is fixed in the anchorage part, each layer or a bundle of layers in each case forms a separate first loop, which separate first loops each have different lengths. This results in progressive fixing of this tensile member in the anchorage part, whereby anchorage and force absorption is unproved significantly.

A further advantageous configuration of an aspect of the invention consists in the fact that the hardenable composition from which the anchorage part is made a mortar-type composition. This mortar-type composition can be cast into a mould in which the one end region of the flexible tensile member has been inserted, whereby a fixed bond is ensured between the mortar-type composition after hardening thereof and the first loops of the flexible tensile member.

Advantageously the surface of the anchorage part is provided with structures which may be provided in the mould in which the anchorage part is produced and in which the first loops are cast, whereby an optimal bond arises between the surface of the anchorage part and the hardenable composition injected into the drilled hole.

Advantageously, the structures consist of ribs projecting above the surface of the anchorage part, which ribs are oriented substantially transversely to the direction of pull of the force acting on the tensile member and on the anchorage part, which results in optimal fixing.

A further advantageous configuration of an aspect of the invention consists in the fact that the anchorage part is surrounded by tension rings at least over sub-regions of its length. These tension rings prevent the longitudinal body hardened from a mortar-type composition from breaking away in these regions.

Advantageously a tension ring is arranged in the entry region of the tensile member into the anchorage part, since force absorption is very great in this region.

Advantageously these tension rings are each arranged in the region of the ends of the first loops of the tensile member in the anchorage part, since in these regions the risk of breaking away is at its greatest.

A further advantageous configuration of an aspect of the invention consists in forming the other end region of the tensile member as a second loop. The tensile member may thus be produced as an endless loop, which has a positive effect on the strength thereof.

Advantageously, a bolt is provided which is arranged in the anchor head device transversely to the direction of pull and over which the second loop of the tensile member can be simply laid, the tensile member being held optimally in the anchor head device.

The bolt is mounted in a tensioning device, which is arranged in the anchor head device, whereby the tensile member may be simply tensioned to a greater or lesser extent by displacing the bolt.

BRIEF DESCRIPTION OF THE DRAWINGS

One embodiment of an aspect of the invention is explained in greater detail below by way of example with reference to the appended drawings, in which:

FIG. 6 is a representation of a ground and rock anchor according to an aspect of the invention when inserted into the substratum;

FIG. 7 is a sectional representation of the ground and rock anchor according to an aspect of the invention when inserted into the substratum;

DETAILED DESCRIPTION

Figure 1:
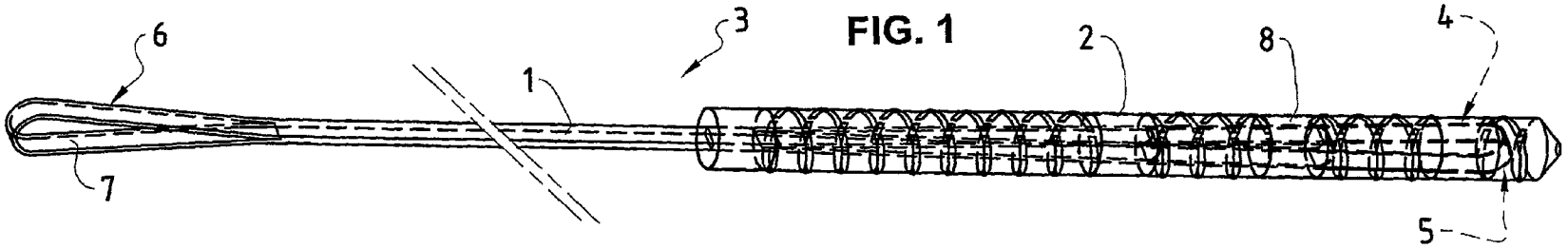
FIG. 1 is a three-dimensional representation of a tensile member of a ground and rock anchor, inserted into the anchorage part.

FIG. 1 shows a longitudinally stable, flexible tensile member 1 with the anchorage part 2 of a ground and rock anchor 3. The one end region 4 of this tensile member 1 is fixed in the anchorage part 2. The anchorage part 2 consists of a hardenable composition, in particular a mortar-type composition, the bond between anchorage part 2 and tensile member 1 being achieved in that the one end region 4 of the tensile member 1 is inserted into a mould or formwork, which mould or formwork is filled by the hardenable composition. After hardening of this composition, the mould or shell can be removed, and an anchorage part 2 is obtained in which the one end region 4 of the tensile member is fixed and held optimally. This anchorage part 2 is formed in the present exemplary embodiment by a longitudinal body 8, which is cylindrical in shape. It goes without saying that it would also be feasible for this longitudinal body 8 to have a prismatic or other suitable shape. In this case, the one end region 4 of the tensile member 1 takes the form of a first loop 5; as will be further described below, the tensile member 1 may comprise a plurality of first loops 5.

The other end region 6 of the tensile member 1 takes the form of a second loop 7, which can be fastened in an anchor head device (not shown), as will be further described below.

Figure 2:
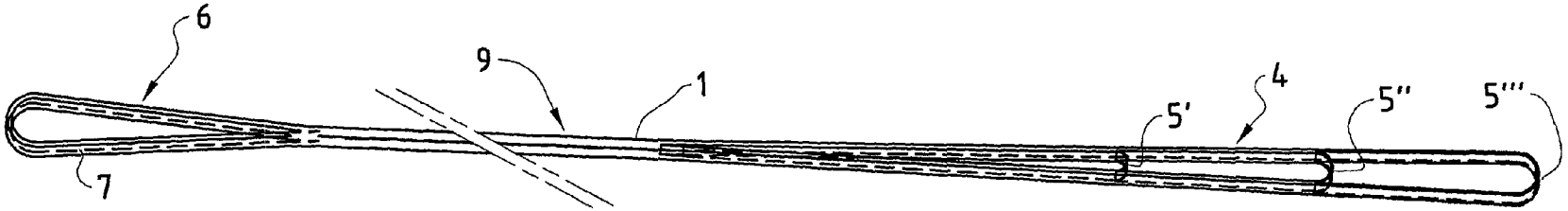
FIG. 2 is a three-dimensional representation of the tensile member with a plurality of first loops and the second loop.

FIG. 2 shows the longitudinally stable, flexible tensile member 1. This tensile member 1 is formed of a fibre reinforced plastics material, preferably of a carbon fibre reinforced plastics material, wherein however glass fibre reinforced plastics materials or other suitable reinforced plastics are feasible. To produce this tensile member 1, a plurality of layers of carbon reinforced plastics material can be used, wherein each of these layers or a bundle of layers forms an endless loop. The innermost layer or bundle of layers forms the first loop 5', the second or middle layer or bundle of layers forms the first loop 5", the outermost layer or bundle of layers forms the first loop 5''', and these three first loops 5', 5" and 5''' and have different lengths. In the region of the second loop 7 all of these layers are superposed, so forming a single second loop 7. In the middle region of the tensile member 1 all the layers forming the loops are arranged superposed each of these layers forms a band and in the middle region 9 the tensile member 1 thus consists of a plurality of superposed bands. These bands may be laminated over the entire length, or they may also be laminated only alternatingly in zones. It goes without saying that another number of layers and loops may also be selected, depending on the mode of application of the ground and rock anchor. The layers may also be arranged superposed and/or next to one another, such that loops of different lengths arranged next to one another are also feasible. Loops having large lengths may additionally also be provided with constrictions.

Figure 3:
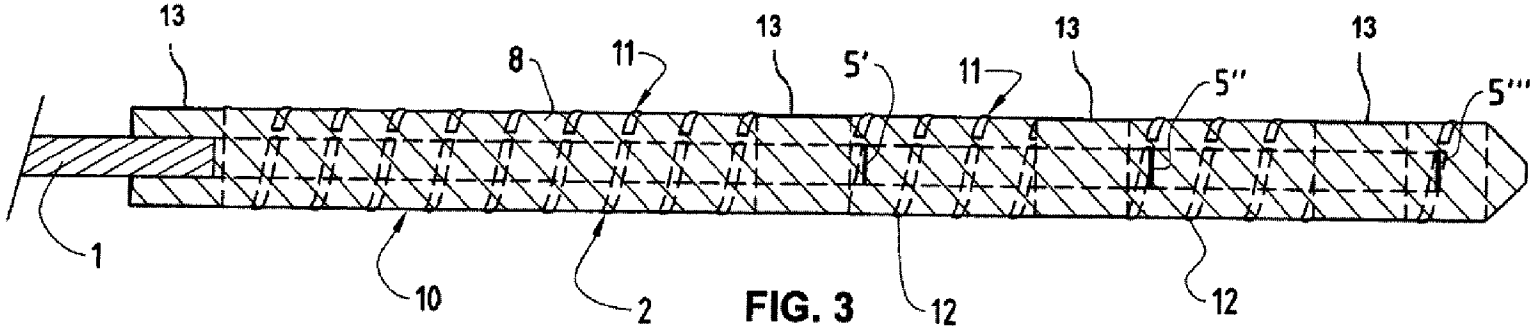
FIG. 3 is a sectional representation through the anchorage part with inserted tensile member and tension rings along line III-III of FIG. 5.
Figure 4:
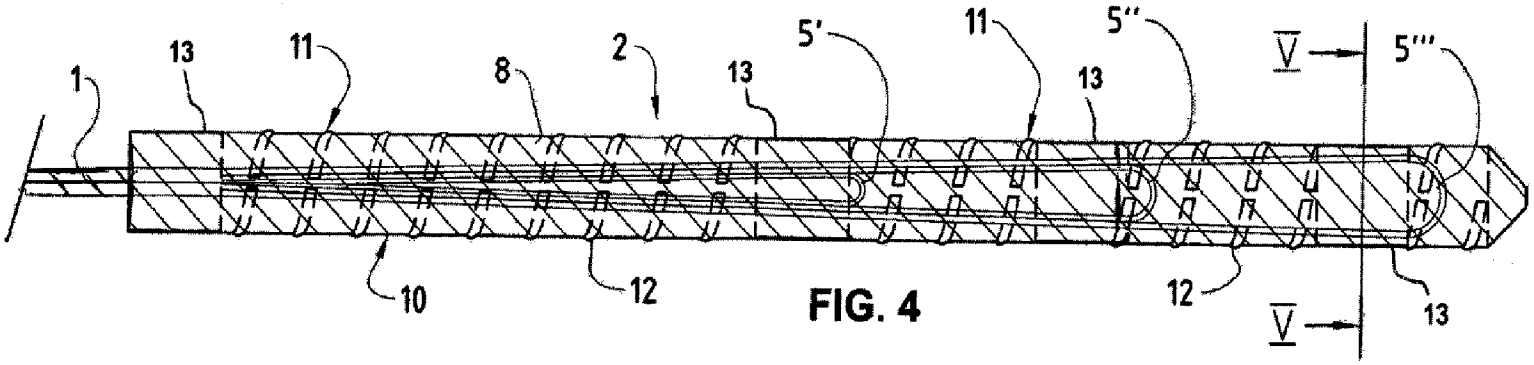
FIG. 4 is a sectional representation through the anchorage part with inserted tensile member and tension rings along line IV-IV of FIG. 5.

FIGS. 3 and 4 show the longitudinal body 8 which forms the anchorage part 2. FIG. 4 in particular shows the first loops 5', 5" and 5''', as embedded in the hardened composition which forms the longitudinal body 8. This arrangement of the first loops 5', 5" and 5''' ensures optimal fixing in the longitudinal body 8, which is formed of the mortar-type composition. Conventionally a known, high strength mortar-type composition is used. This mortar-type composition may also be admixed in known manner with fibrous material for additional reinforcement thereof.

As is likewise apparent from FIGS. 3 and 4, the surface 10 of the longitudinal body 8 forming the anchorage part 2 is provided with structures 11 projecting above the surface 10. In the exemplary embodiment illustrated here, these structures 11 take the form of ribs 12, which are oriented substantially transversely to the direction of pull of the force acting on the tensile member 1 and may for example take the form of spirally extending ribs 12. These structures 11 or ribs 12 are incorporated into the surface of the casting mould, and on production of the longitudinal body 8 using the casting process these are reproduced on the surface 10 of the longitudinal body.

In the region of the ends of the first loops 5', 5" and 5''' and in the entry region of the tensile member 11 into the anchorage part 2, the longitudinal body 8 is surrounded in each case by a tension ring 13, as described further below in detail. These tension rings 13 serve to reinforce the longitudinal body 8 in particular in the entry region of the tensile member 1 into the anchorage part 2 and in the region of the first loops 5', 5" and 5'''. In these regions the risk of the mortar-type composition breaking away when the ground and rock anchor is loaded is minimised thereby.

Figure 5:
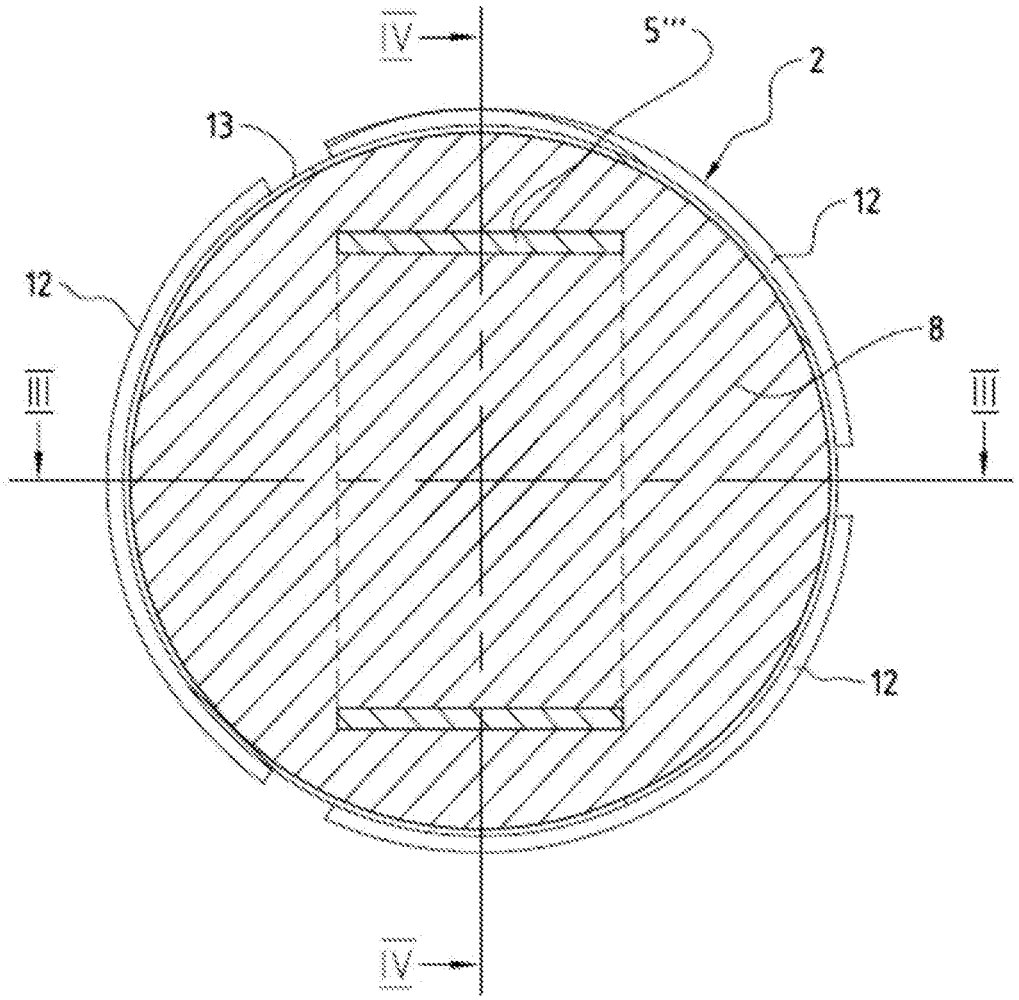
FIG. 5 is a sectional representation through the anchorage part with inserted tensile member along line V-V of FIG. 4.

FIG. 5 shows a cross section through the longitudinal body 8 forming, the anchorage part 2. In this longitudinal body 8 consisting of the mortar composition a first loop 5' or 5" or 5''' is embedded. A tension ring 13 is inserted in each case around the longitudinal body 8 in the region of the loop ends, as has been described above. This tension ring 13, which may likewise consist of a carbon fibre reinforced plastics material, surrounds the longitudinal body 8 in the region of the first loops 5', 5" and 5''', and in these regions break-away of the mortar-type composition is prevented, which serves to reinforce the anchorage part 2. FIG. 5 also shows the ribs 12, which project above the surface 10 of the longitudinal body 8.

FIGS. 6 and 7 show the ground and rock anchor 3 according to an aspect of the invention inserted into the substratum 14 to be stabilised. To this end, the one end region 4 with the anchorage part 2 of the tensile member 1 is introduced into a drilled hole 15 in the substratum 14. Aids may be used in known manner for insertion purposes, such as for example rods for pushing the longitudinal body 8 into the drilled hole 15. After precise positioning of the anchorage part 2 in the drilled hole 15, a hardenable composition may be injected in known manner into the cavity around the anchorage part 2 and the wall of the drilled hole 15, and once this filler material has been hardened an optimal bond is achieved between anchorage part 2 and substratum 14.

The other end region 6 of the ground and rock anchor 3, which takes the form of a second loop 7, is fastened in an anchor head device 16, which, as will be seen later on, takes the form of a tensioning device. Such an inserted ground and rock anchor 3 may have lengths of up to 70 meters or more. With such lengths it may be convenient to subdivide the tensile member 1 into a plurality of parts and to join them using coupling means, which simplifies handling. The longitudinal body 8 may easily have a length of 6 meters, whereby optimal anchoring in the drilled hole 15 of the substratum 14 to be stabilised may be achieved.

Figure 8:
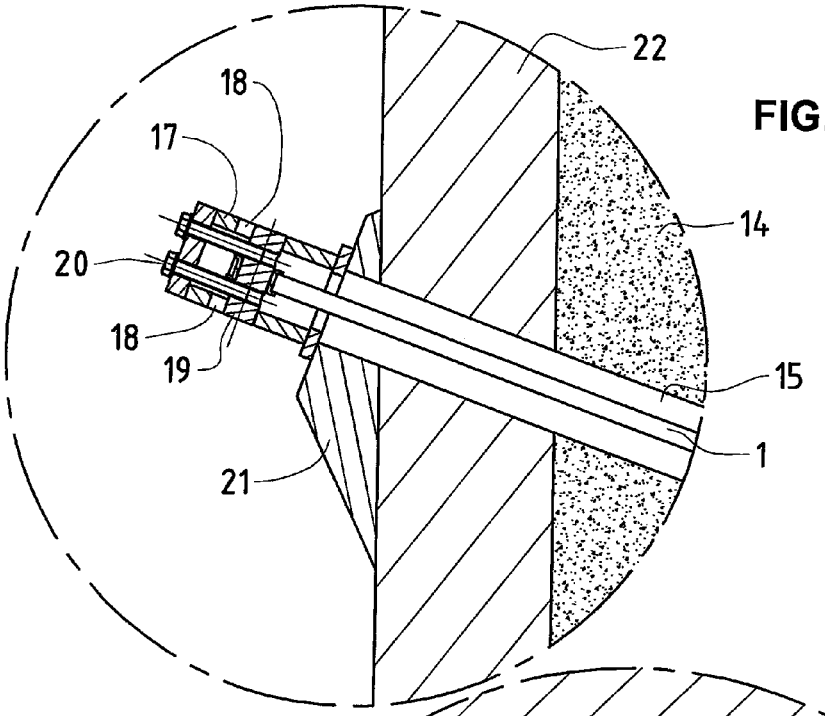
FIG. 8 is a sectional representation of an anchor head device in the inserted state.

FIG. 8 shows the anchor head device 16, with which the other end region 6 of the tensile member 1 of the ground and rock anchor 3 is held. The anchor head device 16 consists of a supporting stirrup 17, which is provided with two longitudinal slots 18. A bolt 19 is inserted into these longitudinal slots 18. The second loop 7 of the tensile member 1 is laid over this bolt 19. The bolt 19 can be tensioned together with the second loop 7 of the tensile member 1 in the direction of the longitudinal slots 18. To this end clamping screws 20 are provided, which are screwed into the bolt 19, and are supported on the supporting stirrup 17. This allows the tensile member 1 to be simply tensioned to the desired tensioning force. The supporting stirrup 17 is supported on a correspondingly shaped supporting section 21 which absorbs inclinations; said supporting plate is placed on a further plate 22, which may consist for example of concrete, and by means of which the substratum is stabilised in the surface region. The anchor head device 16 is protected against corrosion in a known but not illustrated manner.

Figure 9:
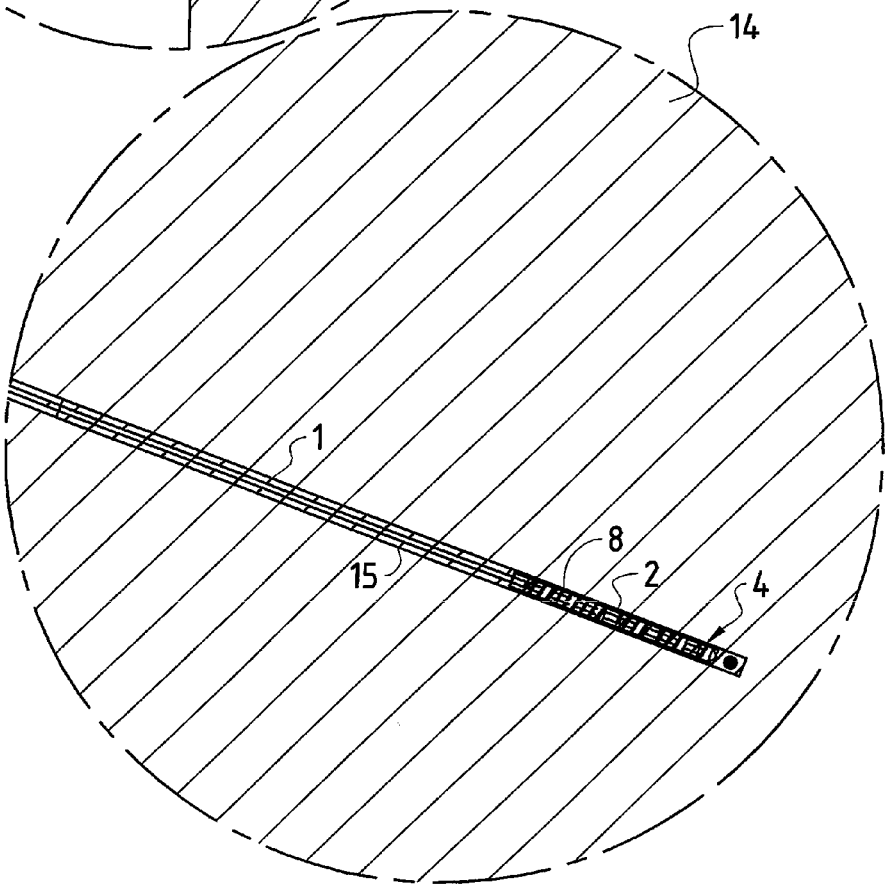
FIG. 9 shows the anchorage part with inserted tensile member when inserted into the substratum.

FIG. 9 again shows the one end region 4 with the longitudinal body 8 of the ground and rock anchor 3 and the anchorage part 2 anchored in the substratum. The tensile member 1 guided through the drilled hole 15 may be left free, but it is also feasible to fill the drilled hole up to the top with an appropriate hardenable composition.

Such a ground and rock anchor is simple to produce, the introduction of force via the anchorage part into the substratum to be stabilised is optimal, the tensile member is not subject to any corrosion, and it thus possible to dispense with corresponding checks. Such ground and rock anchors may be inserted simply into the substratum, and they may also be simply transported, since the tensile member is flexible and may be rolled up, which also saves a great deal of space. In addition, the tensile member is also distinguished by very minimal weight. The tensile member can be appropriately dimensioned, in that the band may be made wider and/or thicker depending on what forces need to be absorbed.

The invention claimed is:

1. A ground and rock anchor, comprising a longitudinally stable, flexible tensile member, an anchorage part in which the tensile member is fixed by one end region of the tensile member, and an anchor head device in which the tensile member is held by an other end region, wherein the anchorage part is designed to be introduced into a drilled hole in the ground or rock and anchored therein, wherein the tensile member comprises at least one first loop at least at the one end region which is fixed in the anchorage part, and the anchorage part is a substantially prismatic or cylindrical longitudinal body formed of a hardenable composition by which the at least one first loop is surrounded.

2. The ground and rock anchor according to claim 1, wherein the tensile member is made from a fibre reinforced plastics material.

3. The ground and rock anchor according to claim 1, wherein the tensile member consists of a plurality of layers, and wherein, in the one end region, each layer or a bundle of layers forms separate first loops, the separate first loops each having different lengths.

4. The ground and rock anchor according to claim 1, wherein the hardenable composition is a mortar-type composition.

5. The ground and rock anchor according to claim 1, wherein a surface of the anchorage part is provided with structures.

6. The ground and rock anchor according to claim 5, wherein the structures consist of ribs projecting above the surface of the anchorage part, which ribs are oriented substantially transversely to a direction of pull of a force acting on the tensile member and on the anchorage part.

7. The ground and rock anchor according to claim 1, wherein the anchorage part is surrounded by tension rings at least over sub-regions of a length of the anchorage part.

8. The ground and rock anchor according to claim 7, wherein, in an entry region of the anchorage part into which the tensile member enters the anchorage part, a tension ring is arranged in the anchorage part.

9. The ground and rock anchor according to claim 8, wherein the tensile member comprises a plurality of first loops and the tension rings are each arranged in regions of ends of respective ones of the first loops.

10. The ground and rock anchor according to claim 1, wherein the other end region of the tensile member comprises a second loop.

11. The ground and rock anchor according to claim 10, wherein a bolt arranged transversely to a direction of pull is provided in the anchor head device.

12. The ground and rock anchor according to claim 11, wherein the second loop is laid over the bolt.

13. The ground and rock anchor according to claim 11, wherein the bolt is mounted in a tensioning device arranged in the anchor head device.

* * * * *